US009067647B2

(12) United States Patent
Neese

(10) Patent No.: US 9,067,647 B2
(45) Date of Patent: Jun. 30, 2015

(54) PORTABLE BOAT LADDER

(71) Applicant: Grady-White Boats, Inc., Greenville, NC (US)

(72) Inventor: David A. Neese, Winterville, NC (US)

( * ) Notice: Subject to any disclaimer, the term of this patent is extended or adjusted under 35 U.S.C. 154(b) by 141 days.

(21) Appl. No.: 13/827,154

(22) Filed: Mar. 14, 2013

(65) Prior Publication Data

US 2014/0261145 A1 Sep. 18, 2014

(51) Int. Cl.
*B63B 17/00* (2006.01)
*B63B 27/14* (2006.01)

(52) U.S. Cl.
CPC ..... *B63B 27/146* (2013.01)

(58) Field of Classification Search
CPC B63B 27/14; B63B 27/146; B63B 2027/141; B63B 2027/146; B63B 17/00; E06C 5/02; E06C 1/36
USPC ..... 114/352, 362, 364; 182/88, 127, 206
See application file for complete search history.

(56) References Cited

U.S. PATENT DOCUMENTS

| | | | | |
|---|---|---|---|---|
| 1,217,279 | A | 2/1917 | Coughtry | |
| 2,758,770 | A | 8/1956 | Wagner | |
| 3,336,999 | A | 8/1967 | McSwain | |
| 3,464,517 | A | 9/1969 | Akermanis | |
| 4,002,223 | A | 1/1977 | Bernkrant | |
| 4,495,883 | A | 1/1985 | Hoy | |
| 4,907,674 | A | 3/1990 | Miller | |
| 5,332,063 | A | 7/1994 | Amacker | |
| 5,645,140 | A | 7/1997 | Mouneimneh | |
| 6,520,291 | B2 | 2/2003 | Andrey | |
| 7,182,175 | B1 | 2/2007 | Schmitt | |
| 7,475,652 | B2 | 1/2009 | Dvorak | |
| 8,074,771 | B2 | 12/2011 | Nickelson | |
| 8,356,568 | B1 * | 1/2013 | Chinn | 114/362 |
| 2009/0008187 | A1 * | 1/2009 | Garelick | 182/91 |

OTHER PUBLICATIONS

Eternal Boating, 3-Step Windline Slide Mount Telescoping Ladder SM-3XOC, available at www.eternalboating.com last accessed Jun. 7, 2012.
Stratos Boats, 210 Elite, available at www.stratosboats.com, last accessed Jun. 7, 2012.
Amazon, Fire Escape Ladders, available at www.amazon.com, last accessed Jun. 7, 2012.
Fire Escape Systems, Extend & Climb Ladder, available at www.fireescapesystems.com, last accessed Jun. 7, 2012.
Lund Boats, 1950 Tyee, available at www.aluminumboatguide.com, last accessed Jun. 7, 2012.
Anchoring, On-Platform Mounted Boat Ladder, available at www.anchoring.com, last accessed Jun. 7, 2012.
Zhejiang Sinostar Marine Industries Limited, Portable Telescopic Boat Ladder With Box, available at www.chinamarinewholesale.com, last accessed Jun. 7, 2012.

(Continued)

*Primary Examiner* — S. Joseph Morano
*Assistant Examiner* — Anthony Wiest
(74) *Attorney, Agent, or Firm* — Olive & Olive, P.A.

(57) ABSTRACT

The portable telescoping boat ladder is easily stored, installed, and used. The ladder comprises a ladder assembly mounted to a base assembly. The ladder assembly comprises telescoping ladder sections able to be collapsed into a stored position with the rungs adjacent each other. The base assembly comprises a platform, a means for engagement with a boat hand rail, and a means for providing a maximum angle at which the ladder assembly may be deployed.

4 Claims, 5 Drawing Sheets

(56) References Cited

OTHER PUBLICATIONS shipstoday.net, Transome Telescoping 4 Step Boat Ladder, available at www.shipstoday.net, last accessed Jun. 7, 2012.

GG Schmitt, Ladder Systems, available at www.ggschmitt.com, last accessed Jun 12, 2012.

Chaparral, Forward Anchor Locker, available at www.chaparralboats.com, last accessed May 27, 2013.

Regal Marine Industries, Inc., 1900, available at www.regalboats.com, last accessed May 27, 2013.

sea-doo.net, 2010 Sea-Doo 210 Wake Sport Boat—Details—bow ladder stowed, available at www.sea-doo.net, last accessed May 27, 2013.

Boating Buddy, Bow to Beach Ladders, available at www.boatingbuddy.com, last accessed May 27, 2013.

Garelick Mfg. Co., The Original Gunwale Eez-in Hook Ladder, available at www.garelick.com, last accessed May 7, 2013.

Windline, Gunwale Hook Ladders, available at www.windline.com, last accessed May 27, 2013.

Windline, Slide Mount Ladders, available at www.windline.com, last accessed May 27, 2013.

* cited by examiner

PORTABLE BOAT LADDER

BACKGROUND OF THE INVENTION

The subject invention relates to telescoping ladders capable of being removably attached to boats and also collapsible for storage.

Telescoping boat ladders, in general, are well known in the field. Telescoping side rails allow such ladders to be stored compactly on a boat, where space is a premium, and extend to allow passengers to climb on and off the boat. The side rails are generally formed with rungs connecting laterally spaced rails that are progressively larger as they are oriented from the bottom rung. The rails are collapsible into one another.

Despite incorporating telescoping side rails, extendable boat ladders often remain cumbersome to store, require permanent attachment to boats, or do not provide secure footing for users as they move from the interior of the boat onto the rungs of the ladder. It would be desirable to provide a boat ladder that features telescoping side rails, incorporates a means for increasing user stability, and easily and removably attaches to the boat.

SUMMARY OF THE INVENTION

The object of this invention is to overcome disadvantages of the known prior art by providing a telescoping boat ladder that incorporates a means for providing a stable tread at the top of the ladder, that easily and removably attaches to a boat using the boat's pre-existing hand rails, and that folds compactly for storage. The design allows for the ladder to be used on either side of the boat, which is an advantage over permanently installed ladders as conditions are not always ideal for entering and exiting on both sides of a boat.

Preferred embodiments of this invention are sufficiently rigid that they do not require support at the bottom of the extended ladder. In a preferred embodiment, the invention also does not require a stand off to keep the ladder in a vertical orientation to allow space behind the ladder rungs for a user's toes.

These and other objects, features, and advantages are accomplished according to the subject invention by providing a telescoping ladder that may be deployed across the bow or gunwale of a boat and that incorporates a top platform. The ladder assembly is formed with telescoping ladder sections able to be collapsed into a stored position with the rungs adjacent each other. The ladder assembly is mounted to a base assembly, which comprises a platform, a means for engagement with a boat hand rail, and a means for providing a maximum angle at which the ladder assembly may be deployed. Other components may also be incorporated.

DETAILED DESCRIPTION OF THE DRAWINGS

As may be seen in an embodiment of the present invention depicted in FIGS. 1-6, the inventive ladder 10 comprises a base assembly 20 and a ladder assembly 40. The detailed description that follows is with reference to this depicted embodiment.

In the embodiment of the present invention depicted in FIGS. 1-6, the inventive ladder 10 comprises a base assembly 20 and a ladder assembly 40. The base assembly 20 is connected at one side (referred to hereafter as its lower end) to the upper end of the ladder assembly 40, as described with respect to this embodiment in more detail hereafter.

Figure 1:
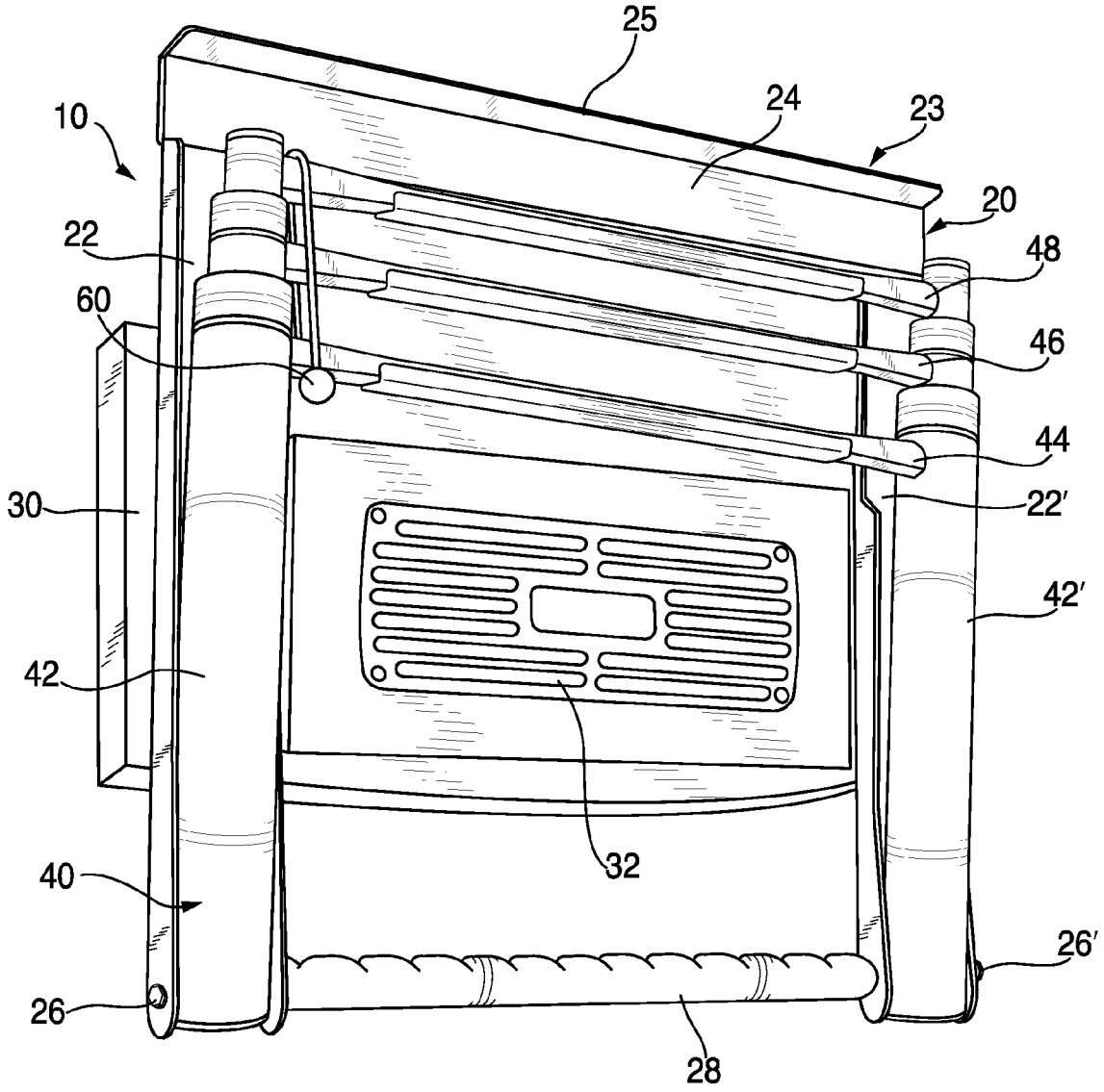
FIG. 1 is a top view of an embodiment of the inventive boat ladder when fully collapsed.

The base assembly 20 comprises two side sections 22, 22', and a base rung 28. Side sections 22, 22', are parallel to one another and are connected at their respective lower ends to base rung 28. In one embodiment, as shown in FIG. 1, the side sections 22, 22', are formed so as to create a channel within which side rails 42, 42', may rest when the inventive ladder is collapsed. Alternative embodiments may provide varying degrees of side rail envelopment or no envelopment at all.

The base assembly 20 is hingedly connected to the ladder assembly 40. In the preferred embodiment, as most clearly shown in FIGS. 4 and 5, the lower ends of side sections 22, 22', are formed so that the upper ends of the side rails 42, 42', can rest and swivel therein, rotating around and connected by the hinge bolts 26, 26'. A user can thus cause the side rails 42, 42', to swivel into a closed position, lying adjacent to (and partially within the channel of) the side sections 22, 22', or alternatively to swivel into an open position, away from the base assembly 20. Alternate forms of hinges to connect the ladder assembly to the base could be utilized as will be readily apparent to those skilled in the art.

The base assembly 20 further comprises a top platform 30. The top platform 30 is connected to the side sections 22, 22', and is dimensioned and manufactured such that it can support the weight of a user climbing into and out of a boat. The top platform 30 may further comprise a tread 32 to decrease the incidence of slipping by users of the ladder 10. It is contemplated that one side of the top platform 30 will lie snugly against the top of the boat's bow or gunwale 110 and will be made of a material that will not damage the boat body, such as fiberglass, rubber, or plastic, or if made of a material or formed in a manner that otherwise would be likely to damage the boat, that the top platform 30 will further comprise padding on the side opposite the tread 32, in the location that will engage the boat body. An example of the inventive ladder with its top platform 30 resting against a boat gunwale 110 can be seen in FIG. 6.

Figure 2:
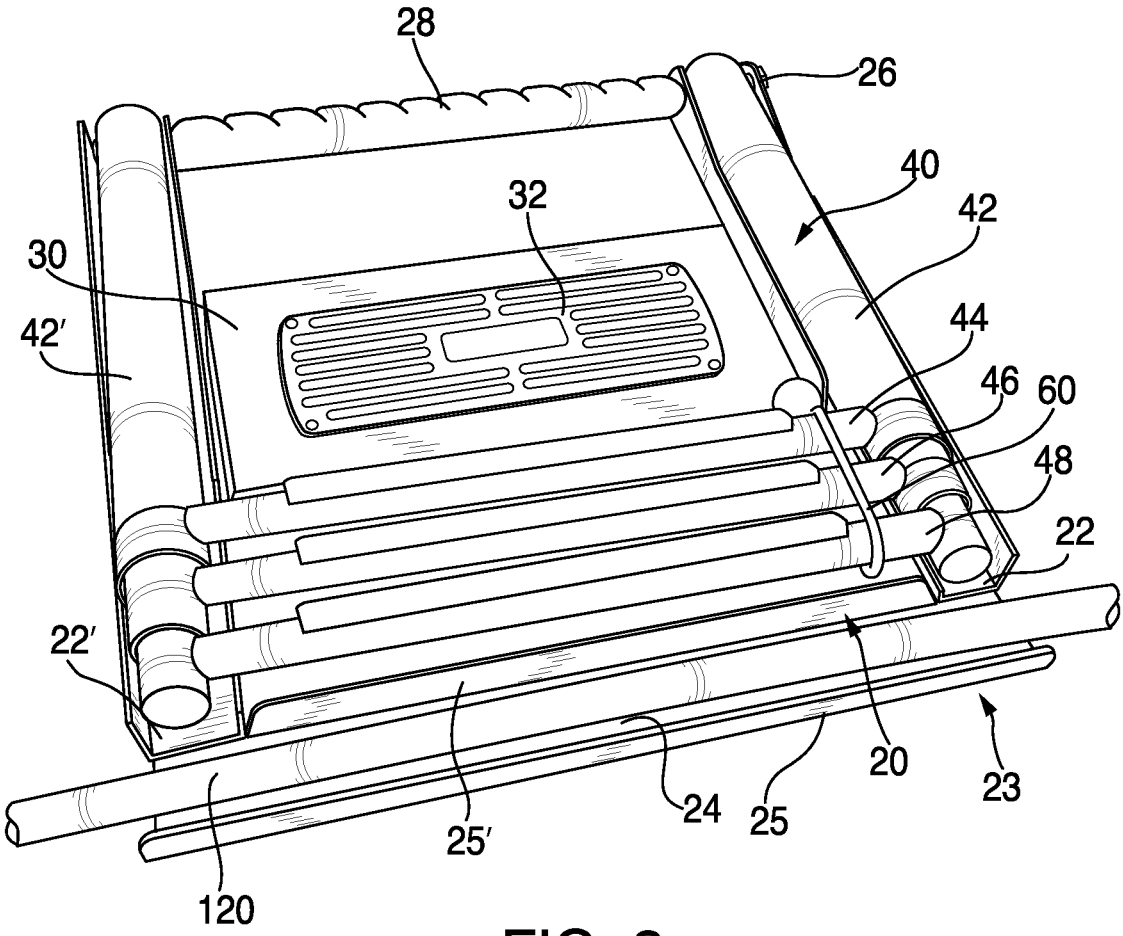
FIG. 2 is a top view of the embodiment shown in FIG. 1 partially deployed.
Figure 6:
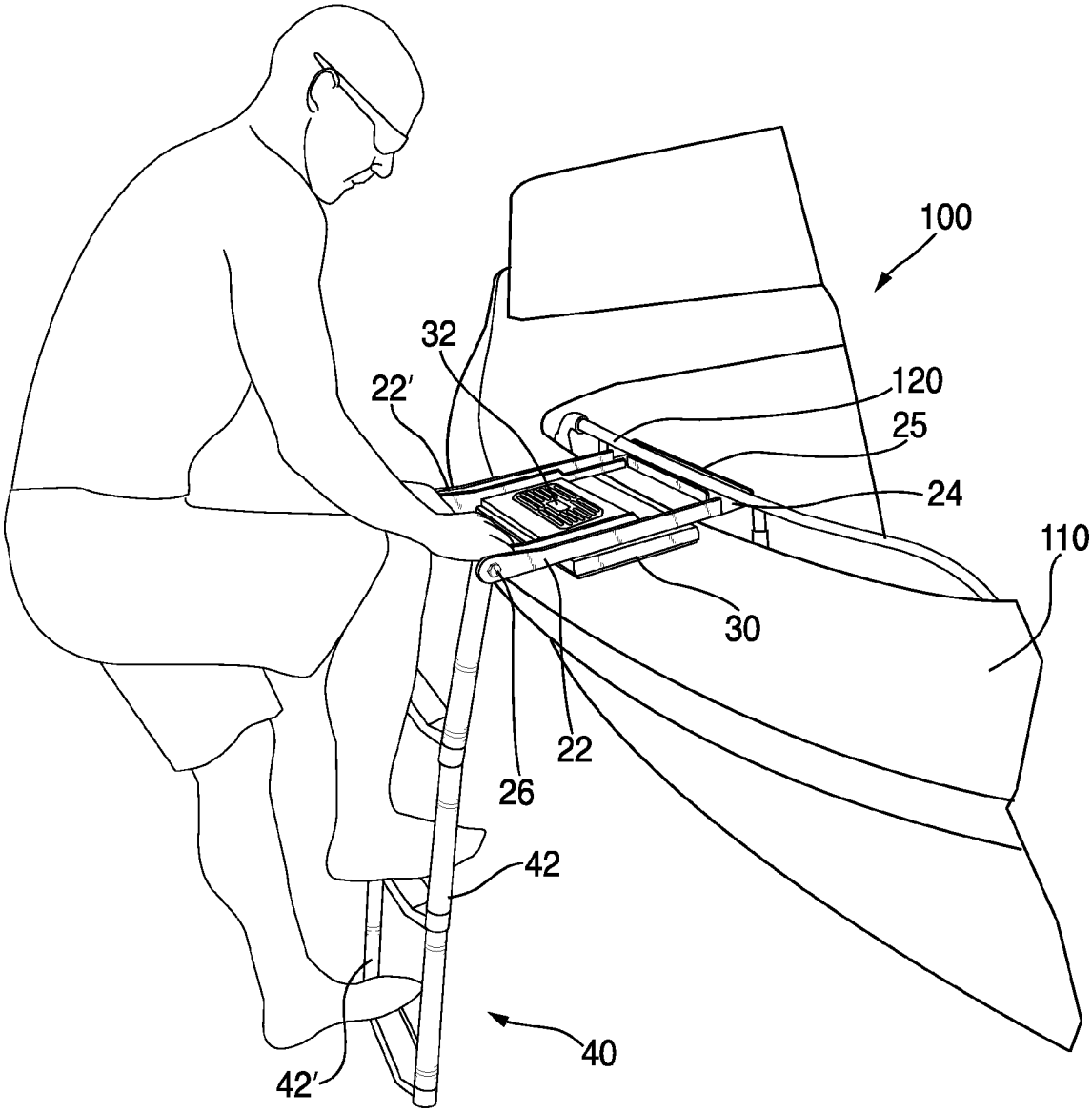
FIG. 6 is a perspective view of the embodiment shown in FIG. 1 fully deployed and in use.

The base assembly 20 further comprises a connector 24 for engaging the ladder 10 to a boat rail. In the depicted embodiment, the connector 24 is a channel connector, comprising a structure extending the full distance between the side sections 22, 22', of the base assembly 20, formed as a substantially rigid channel having holding tabs 25, 25', which in the depicted embodiment are the sides of the channel. When in use, the connector 24 engages with the boat handrail 120, and is prevented from sliding off that rail by the holding tabs 25, 25'. A partial view of a boat 100 with an embodiment of the inventive ladder engaged to a boat hand rail 120, as preferred, is shown in FIG. 6. A depiction of the boat rail 120 securely engaged within the connector 24 is shown in FIG. 2. In the depicted embodiment, the holding tabs 25, 25', are at least as tall as the radius of a standard handrail of a family or fishing boat.

Although the connector 24 preferably is formed as a channel with holding tabs comprising the sides thereof and extending for substantially the full length thereof, it is not necessary that the holding tabs extend the full length of channel connector 24 on either or both sides, and there could be different numbers and sizes of holding tabs. Alternatively, other connectors such as a crossbar running between side sections 22, 22', and with hooks or carabiners attached thereto could be used.

Figure 3:
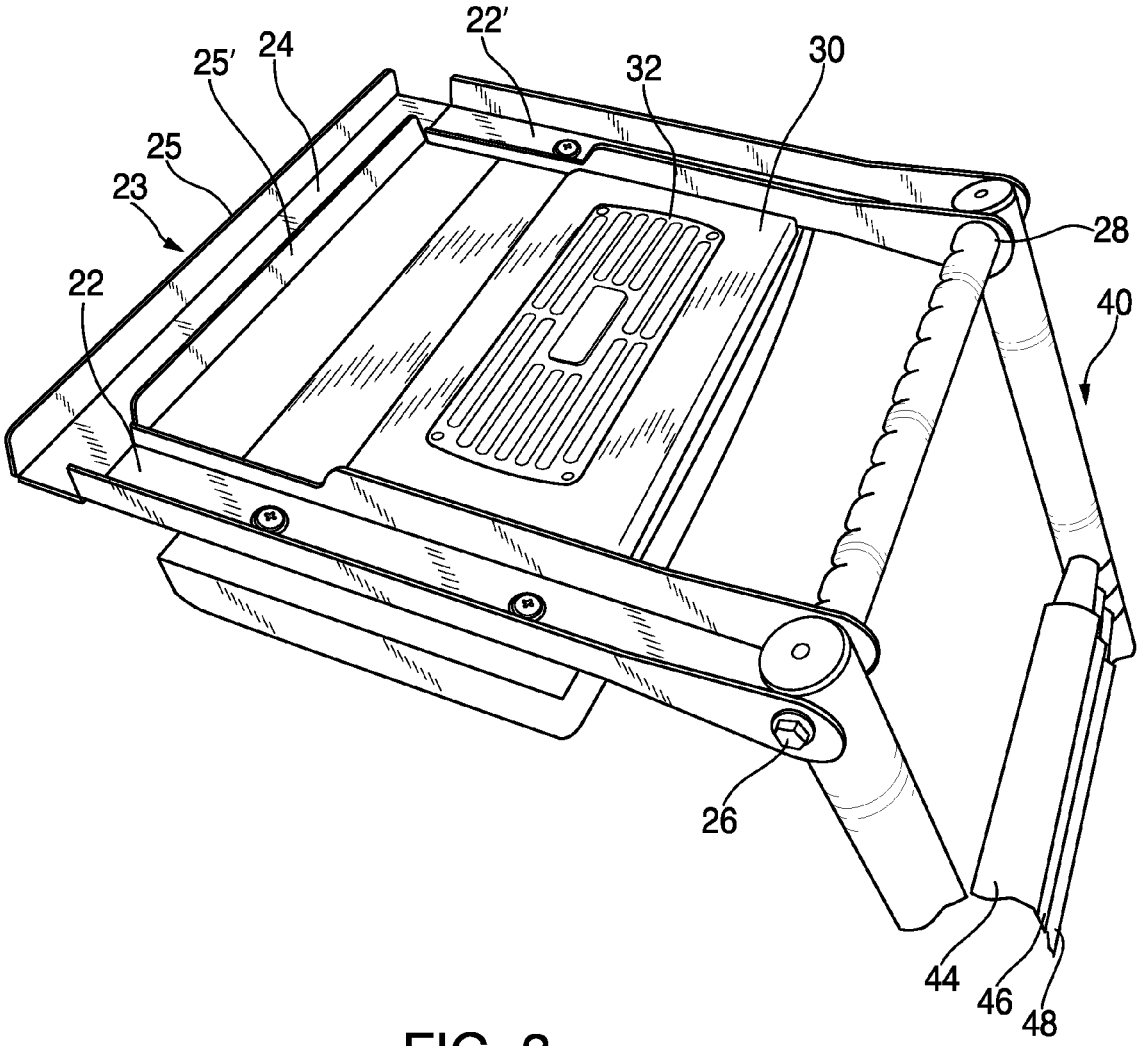
FIG. 3 is a detail view of the embodiment shown in FIG. 1 when further deployed.
Figure 4:
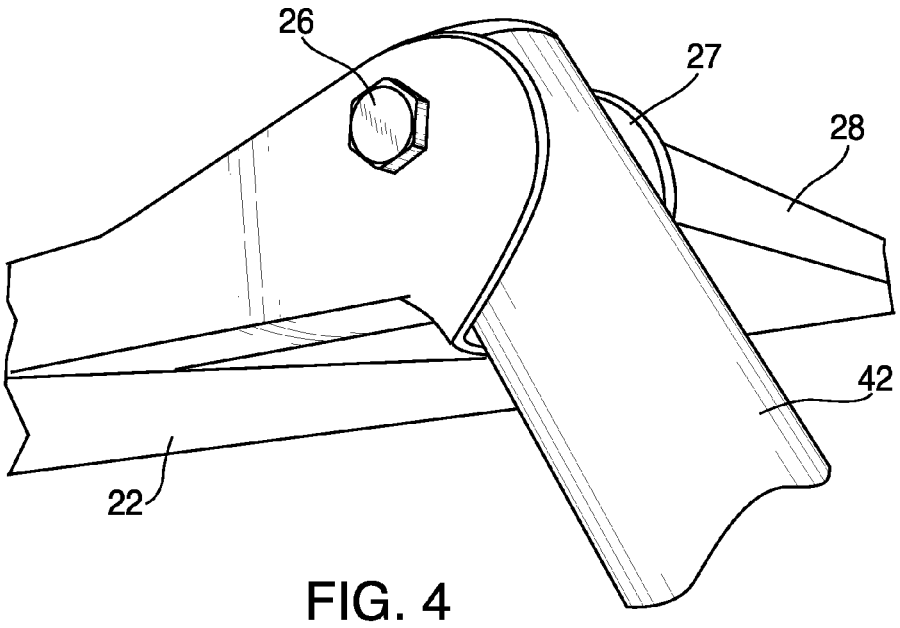
FIGS. 4 and 5 are perspective detail views of the top and underside of the hinge portion of the embodiment shown in FIG. 1.

The side sections 22, 22', and various components of the top platform 30 may be manufactured as one piece or separately. As shown in FIG. 3, a separately manufactured top platform 30 may be connected to the side sections 22, 22', for example, by screws or bolts 26, 26'.

At their bottom ends, the side sections 22, 22', are connected by hinge bolts 26, 26', to a base rung 28. The hinge bolts 26, 26', connect the base assembly 20 to the ladder assembly 40 such that a user may cause the side rails 42, 42', to fold to lie adjacent to the side sections 22, 22', or to open away from the base assembly 20.

The base assembly 20 also further comprises a means for providing a maximum angle at which the ladder assembly 40 may be opened away from the base assembly 20. In the embodiment depicted as shown in detail in FIGS. 4 and 5, this is provided by the forming of open hinge joints 27, 27', on the underside of the side sections 22, 22', at the end opposite the top section 23. The open hinge joints 27, 27', function similarly to trochlear grooves in human elbow joints and are formed such that the side rails 42, 42', may be opened away from the base assembly 20 so as to form no more than a 270 degree angle. This may also be accomplished by other means, such as incorporating fixed brackets into the base assembly 20.

The ladder assembly 40 comprises a conventional design in that the side rails 42, 42', are each comprised of a plurality of segments with increasingly smaller diameter, each of which is telescopically received within the segment above it. A plurality of rungs 44, 46, 48, span the corresponding side rail segments and are formed to collapse into a position in which the rungs 44, 46, 48, are positioned adjacent one another as depicted in FIGS. 1 and 2.

Figure 5:
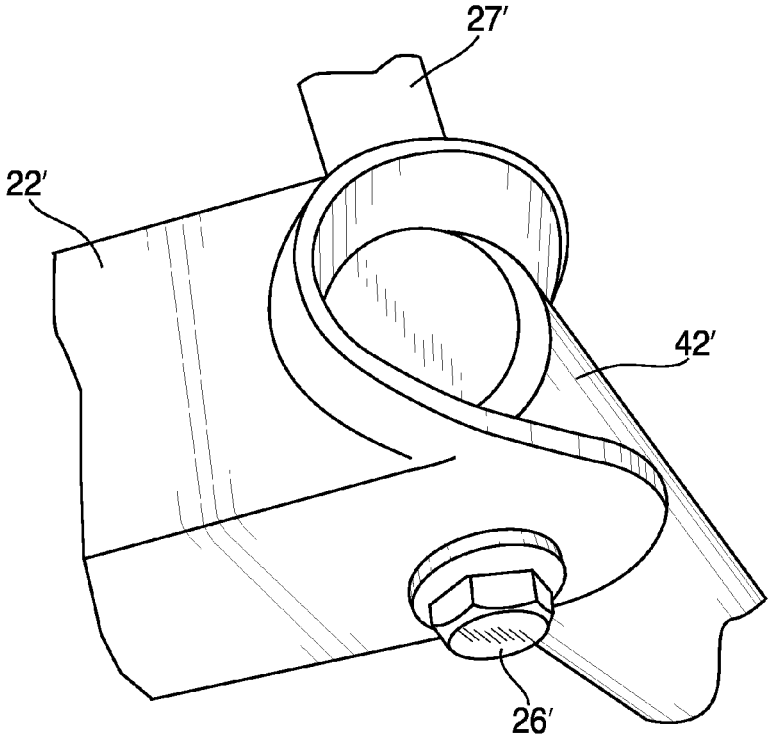

The inventive boat ladder 10 is highly compact when fully collapsed as shown in FIG. 1 and, thus, easy to store while not in use. The ladder 10 is also easy to install and use on a fishing or family boat 100 such as is shown in the accompanying figures. As shown in FIG. 2, with the ladder 10 in collapsed position, a user may simply slide the top section 23 underneath a handrail 120 of the boat 100, causing the connector 24 to frictionally engage with the underside of the handrail 120 and the holding tabs 25, 25', to frictionally engage with the far side of the handrail 120. The top platform 30 is laid across the gunwale 110 with the tread 32 facing up. As shown in FIGS. 3 and 5, the user may then complete deployment by pulling the collapsed ladder assembly 40 away from the base assembly 20, swinging the ladder assembly 40 over the edge of the gunwale 110, and fully extending the side rails 42, 42' so that the rungs 44, 46, 48 are spaced apart. The top platform 30 provides stable footing for a user exiting or entering the boat. The ladder 10 need not be supported at the bottom rung 48 but will still provide adequate support to a user during entry and exit of the boat. The ladder 10 will also be held at a proper angle for ease of entry and exit without the use of step offs due to the open hinge joints 27, 27'.

The inventive ladder 10 may be made with various additional features. One such feature may be handrails, which may collapse or fold into ladder to maintain its compact size when collapsed. The ladder 10 may also comprise a means to secure the ladder rungs 44, 46, 48, such as tie downs or a locking mechanism, so that they may not be deployed unintentionally. A bungee ball cord 60, which would serve this purpose, is shown in FIGS. 1-2.

The structural components of the inventive ladder 10 should preferably be manufactured from one or more materials that are substantially rigid, will withstand repeated exposure to water, and are strong enough to withstand the weight of anticipated users, typically several hundred pounds. The main structural components of boat ladders are typically made of stainless steel for its durability and light weight, and this would be an appropriate material for the principal structural components of the inventive ladder 10, such as the side sections 22, 22', top section 23, base rung 28, and ladder assembly 40, as well. Aluminum is another option.

The foregoing details are exemplary only. Other modifications or additions that might be contemplated by those of skill in the art are within the scope of this invention, and are not limited by the examples illustrated herein.

I claim:

1. A telescoping boat ladder, comprising: a base assembly connected to a ladder assembly;

said ladder assembly comprising a plurality of ladder sections telescopically connected to permit movement between a compact storage position and an extended deployed position; said base assembly comprising;

a) a top section having a connector formed as a channel approximately as wide as the diameter of a boat handrail and having holding tabs for engaging the boat handrail, and said holding tabs extending upward from the channel, said holding tabs being approximately half the height of the boat handrail, b) a pair of parallel side sections, each connected to the top section at a first distal end and having an open hinge joint at a second distal end, c) a base rung, connected to the side sections at their second distal ends, d) a pair of hinges connecting the base assembly to the ladder assembly, and e) a platform connected to the parallel side sections between the first and second distal ends.

2. The telescoping boat ladder of claim 1 wherein the open hinge joint prevents the ladder assembly from being deployed at an angle greater than 270 degrees.

3. The telescoping boat ladder of claim 1 wherein the top platform further comprises a tread.

4. The telescoping boat ladder of claim 1 wherein the top platform is manufactured from one of fiberglass, rubber, or plastic.

* * * * *